US006984795B1

(12) United States Patent
Kowalik

(10) Patent No.: US 6,984,795 B1
(45) Date of Patent: Jan. 10, 2006

(54) CENTER BREAK SWITCH WITH REDUCED OPENING FORCE REQUIREMENT

(75) Inventor: Peter M. Kowalik, Trafford, PA (US)

(73) Assignee: Cleaveland /Price Inc., Trafford, PA (US)

( * ) Notice: Subject to any disclaimer, the term of this patent is extended or adjusted under 35 U.S.C. 154(b) by 173 days.

(21) Appl. No.: 10/645,068

(22) Filed: Aug. 21, 2003

(51) Int. Cl.
*H01H 31/00* (2006.01)

(52) U.S. Cl. ..... 200/48 CB

(58) Field of Classification Search ..... 200/48 R, 200/48 P, 48 KB, 48 SB, 48 CB, 49; 218/7, 218/14–21
See application file for complete search history.

(56) References Cited

U.S. PATENT DOCUMENTS 2,835,756 A * 5/1958 Bagnagatti ..... 200/48 CB
3,227,830 A * 1/1966 Ransom ..... 200/48 CB
3,348,002 A * 10/1967 Upton, Jr. ..... 200/48 R
3,566,061 A * 2/1971 Bernatt ..... 200/48 R
4,244,825 A * 1/1981 Grinninger ..... 252/609
4,759,869 A * 7/1988 Ohno et al. ..... 252/299.67
5,061,833 A * 10/1991 Hodder et al. ..... 200/255
5,293,012 A * 3/1994 Levi ..... 200/48 P

OTHER PUBLICATIONS

Cleaveland/Price Inc., Bulletin DB–126A02, "Aluminum Center Break Switch", (published 2002).
Porter, Catalog 1–055, Issue No. 1, Nov. 1974, "LPC Center Side Break Disconnect Switch".
Johnson Manufacturing Company, "Type M Center Break Switch" (pub. date not shown).
Siemens–Allis, DS 1.3a, Jul., 1979, "Group Operated Switches".
Westinghouse, supplement to descriptive bulletin 36–250, "outdoor disconnecting switches type CB center side break", Dec., 1962.

* cited by examiner

*Primary Examiner*—Marina Fishman
(74) *Attorney, Agent, or Firm*—Gordon H. Telfer

(57) ABSTRACT

A switch has respective open-assist bars fixed to switch blades near the switch contacts. The bars are arranged so that, as the blades are turned by rotation of their supports, the bars come together and serve as a fulcrum mechanism that provides a prying action helping reduce the required opening force. The action of the fulcrum mechanism overcomes friction between the contacts that may otherwise tend to cause bowing of the supports with appreciable increase in the required opening force.

20 Claims, 4 Drawing Sheets

CENTER BREAK SWITCH WITH REDUCED OPENING FORCE REQUIREMENT

BACKGROUND OF THE INVENTION

1. Field of the Invention

The invention relates to center break switches, such as for electrical power substations and transmission lines, and particularly to such a switch in an arrangement facilitating opening of the switch.

2. Background Art

Center break switches have (in a single pole) two switch blades with mating contacts that meet, and separate, between a pair of rotatable blade supports. In a common type, the blade supports include ceramic or polymer insulators that are generally cylindrical with lateral sheds. The supports are joined at one end (nominally, the "bottom") to a quite rigid metal base with a bearing for rotation of each support relative to the base and a mechanism for imparting rotational force to both supports, hence moving the switch blades into or out of a closed contact position. The supports, and their axes of rotation, are substantially parallel to each other in one switch type or, in another type, are in a substantially V-shaped configuration. Switches of interest include those described and illustrated in Cleaveland/Price Inc. descriptive bulletin DB-126A02, "Aluminum Center Break Switch", published in 2002, that is representative of prior art to the present invention.

Operation of such switches is in some cases manual (e.g., by a handcrank or a swing handle) and in some cases by electric motor. Whether manually or motor operated, it is desirable to operate the switch easily and quickly with only modest requirements on the equipment and personnel. For example, some switches have a handcrank operator for manual operation. The handcrank is connected to the rotatable support apparatus through a gearbox with a gear ratio typically in a range from about 10:1 to 40:1, as specified by a user. A higher gear ratio allows a switch to be opened with less manual force but requires more time, which is generally undesirable.

Another factor in switch operation is that a typical installation has three poles, substantially alike, one for each phase of a three phase electrical system, and the operator must apply sufficient force to operate all three poles together. A maximum operating force, for three-phase switches, is typically specified to be in a range from about 35 to 70 pounds. Some installations have switches ganged together in even larger numbers, such as six poles with two poles for each phase of a three phase system.

Center break switches are now applied over a wide range of voltages, including high voltage systems up to a nominal rating of at least about 230 kV. Required switch size increases with increasing voltage (for contact clearance when the switch is open and for sufficient distance across the insulative supports) so that the rotatable supports and the contact blades reach up to several feet in length. This makes for a relatively massive structure to be moved and the longer supports make them more subject to bowing that can affect operation. In general, however, considerations affecting the opening force requirements apply to some degree regardless of the switch size or the number of switches operated together.

Switches operate in a variety of environments including those that can, particularly with age, change the amount of required operating force. One type of known switch has contacts with engaging surfaces that meet substantially in a horizontal plane like that of the arcuate motion of the contacts resulting from blade supports' rotation. This produces considerable wiping action between the contacts during opening and closing that helps keep the contact zone free of debris and oxides. In this respect, sliding friction between the contacts enhances switch performance while also having an influence on the required opening force.

A variety of contact configurations are used in various center break switches. For example, some have appreciable contact engagement in a vertical plane that is substantially perpendicular to the plane in which the blades move. Still, in any of the contact configurations, there is some degree of sliding friction that can affect switch opening. Prior art has largely relied on a basic assumption that the axes of rotation of the insulative supports are substantially fixed. While prior center break switches have been generally successful, their design has not addressed the fact that sliding friction between the contacts during a switch opening can alter the location of the axes of rotation of the supports, particularly, but not limited to, those of larger units. Altering the axes of rotation by contact friction results in greater required force and time to separate the contacts than if those axes were fixed.

SUMMARY OF THE INVENTION

The present invention takes into account the effects of friction, including possible bowing movement of the support axes, and provides a simple arrangement for facilitating switch opening despite such friction effects.

Without friction, a center break switch would open very easily with no forces to distort the axes of rotation of the supports. With the switch blades at fixed support axes, the blades would swing the contacts from a fully closed position to a point of separation while only traversing a minimum distance. However, friction between contacts can change that by introducing a drag effect altering the geometry.

Sliding friction between contacts can cause the points of rotation of the blades, at the upper end of their supports, to move toward each other due to bowing of the insulative supports. This is because the contacts generate forces to overcome the sliding friction so that during the time contact motion has begun, but the contacts are still not separated, the contacts are not moving in a perfect arc. Their separation will only occur a distance beyond the minimum distance referred to above. With that change, the required torque and operating force is increased. Also, somewhat more time is required.

Now, in one embodiment of the present invention, a fulcrum mechanism is combined with the switch elements that may be like the prior art in other respects. It can include two additional members, such as bars (sometimes they may be referred to by alternative expressions such as pry bars, pry-open bars, pry-out bars, pivot bars, easy open bars, or open-assist bars) that are added in combination with a typical center break switch of the prior art. The "bars" need not be very elongated and can be any members that abut each other as described below during a switch opening. The elements of the fulcrum mechanism can be members attached to the respective blades or elements integral with the blades.

The bars are, in one example, relatively flat, stiff, metal plates, approximately "L" (or backward "L") shaped. One bar is on each switch blade, e.g., with the bottom of the "L" (or backward "L") bolted to the blade behind the contact on that blade and the upper parts of the bars extending beside the contacts to face each other. The facing portions abut and contact each other during a switch opening along with initial contact movement and before full separation. That is, the upper parts of an "L" on a right side blade and the upper part of a reverse "L" on a left side blade are located behind the contacts (with respect to the direction the contacts move) and the ends of the "L" and reverse "L" bars, which have some width and thickness, possibly with a flange-like end, meet to produce the intended effect.

While the contacts are engaged in sliding friction, the bars provide a new pivot point, or axis of rotation, during the opening motion that pries the contacts apart and forces them to stay on a more perfect arc as they open. The bars reduce bowing movement of the insulator supports and provide a contact parting at a point substantially like one that would exist if there were no sliding friction, even though the contacts do experience the same friction and wiping action.

The bars can be simply formed with the shape mentioned just as an example. Their conductivity is not an issue as far as producing the effect described. They need not touch in the fully closed position and need not have any direct contact with the switch contacts. (If the bars are metal, it is generally preferred to avoid any such contact.) They can be arranged to stay clear of any auxiliary switch elements near the contacts, such as arc horns, and may be attached at any convenient location along the blades, including at the same bolt locations arc horns are attached. Fortunately, the bars assist appreciably in an opening operation without interfering with a switch closing. They can be arranged to have little or no contact with each other during a closing operation and not appreciably alter the closing force.

The earlier contact release point that is achieved appreciably reduces the required operating force. A prototype test on a 230 kV, 3000 ampere switch showed a reduction in operating force on a handcrank gearbox (having a gear ratio of 20:1) from about 40 pounds without the bars to about 15 pounds with them in place, with the same contact pressure. Such switches have insulative supports over seven feet long and switch blades with a radius of about five feet.

The arrangement can be economical, effective, and readily implemented on switches already in service. It provides a convenient alternative, or a complement to other approaches that could be taken, such as providing a higher ratio gearbox for a handcrank operator.

Ancillary benefits include an opportunity to have higher contact pressure because the pry bars alleviate concern that less pressure should be maintained for easier opening. Also, flexibility of insulators can be less of a concern, so they can possibly be made from a wider range of materials.

These and other aspects of the present invention will be further understood from the following text and drawings.

DETAILED DESCRIPTION OF THE INVENTION

Figure 1:
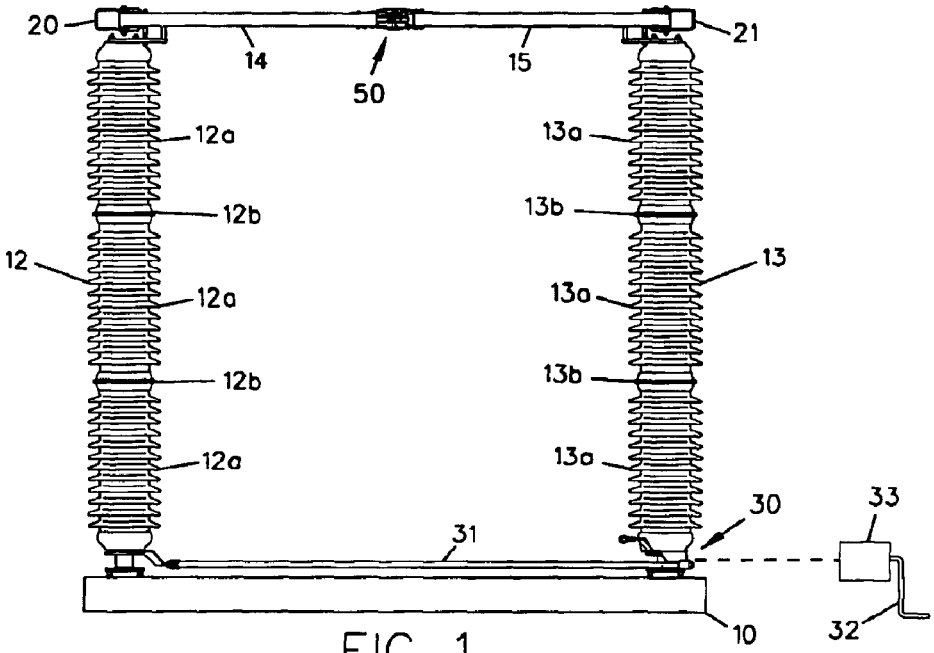

FIGS. 1, 2, 3, 4, and 5 are of the same apparatus although some elements are shown only in FIG. 1. While each of FIGS. 1, 2, 3 and 4 show a fully closed switch position, FIG. 2 also shows a position after contact separation.

FIG. 1 shows a switch (one-pole) with a rigid base 10, e.g., of hot-dip galvanized steel, on which moveable elements of the switch are mounted. Rotatable supports 12 and 13 are mounted at their bottom ends with bearings (not shown) for their rotation relative to the base 10. In this example, the supports 12 and 13 each include a respective stack of insulators 12*a* and 13*a* with intermediate metal couplings 12*b* and 13*b*. The insulators 12*a* and 13*a* are generally of a polymer (e.g., fiber reinforced plastic) or a ceramic material. Even though they are not intended to flex, the insulators are subject to some inherent flexing due to the described friction effects.

Contact blades 14 and 15 are respectively joined to the upper ends of supports 12 and 13 (FIG. 1). Near the supported ends of the contact blades 14 and 15 there is a respective one of a pair of line terminals 20 and 21 for connection with a conductor of an electrical system. Features for pivoting of the blades 14 and 15 in relation to the relatively fixed terminals 20 and 21 are included but will not be detailed herein and may be the same as prior art. The blades 14 and 15 have ends away from the supports 12 and 13 with blade ends, contacts and members to assist in switch opening (to be discussed later) in an assembly identified collectively by reference numeral 50 in FIGS. 1 and 2 with more detailed identification of the elements in the subsequent enlarged views.

The blades 14 and 15 are, for example, each a single piece, aluminum, square tube. Each blade 14 and 15 has one of a pair of switch contacts 16 and 17 at its end opposite its respective support 12 or 13.

Figure 3:
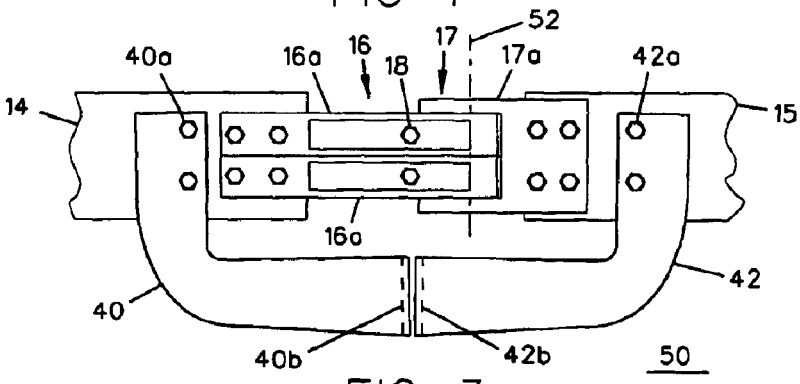
FIG. 3 is an enlarged plan view of part of the switch of FIGS. 1 and 2.
Figure 4:
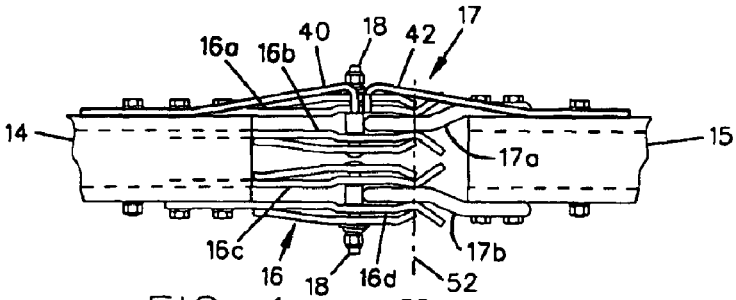
FIG. 4 is an elevation view of the parts shown in FIG. 3.

In this example, as shown in FIGS. 3 and 4, the left side contact 16 includes four pairs of conductive fingers: two upper pairs each having a top finger 16*a* and a bottom finger 6*b* and two lower pairs each having a top finger 16*c* and a bottom finger 16*d*, all of which are conductively joined near their left ends to the blade 14.

The right side contact 17 includes a pair of conductive stabs 17*a* and 17*b*, both conductively joined near their right ends to the blade 15, that are respectively captured (in the closed position) within a jaw formed by the upper pairs of contact fingers 16*a* and 16*b* and within a jaw formed by the lower pairs of contact fingers 16*c* and 16*d*. The elements of contacts 16 and 17 are highly conductive, e.g., silver plated or silver overlaid copper.

In addition, there is a contact pressure adjusting mechanism 18, such as one supported from the blade 14 with bolts and adjusting nuts bearing on spring plates that bear against the fingers of contact 16.

The figures omit for greater clarity corona or arc reducing spheres or horns, and also an ice shield, that are conventionally arranged near contacts of such a switch as that shown.

At the bottom of the switch (FIG. 1) a mechanism 30 is provided for operation of the switch including a tie rod 31 mechanically coupled to both insulative supports 12 and 13 at metal flange members not detailed here. Bearings (not shown) for rotation of the supports 12 and 13 relative to the rigid base 10 are located near the attachments of rod 31.

In this example, the mechanism 30 further includes a handcrank 32 schematically shown in a mechanically coupled relation through a gearbox 33 to the tie rod 31 that transmits rotational force to the supports 12 and 13, both together and also typically together with force transmitted to two other switch poles of the same nature, as is later discussed in connection with FIG. 6.

All of the elements discussed so far (not including any open-assist members 40 and 42 as described below) may be in accordance with known prior art switches such as, but not limited to, that described in the above mentioned background publication which is incorporated by reference herein for further description of examples of the construction and use of such switches, including both those with substantially parallel rotatable supports (as shown here) and those with substantially V-oriented supports (not shown herein) with otherwise similar features.

Figure 2:
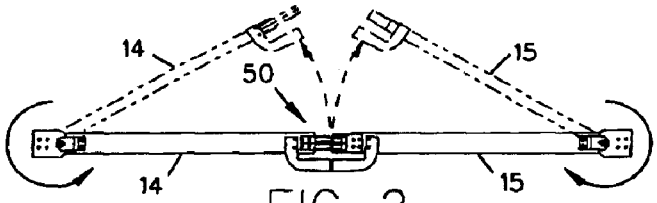
FIGS. 1 and 2 are, respectively, side elevation and top plan views of a center break switch showing an embodiment of the invention where FIG. 2 omits for clarity elements of FIG. 1 below a top portion.

While the invention is not so limited, the contacts 16 and 17 in this example have fingers and stabs that engage each other in one or more planes parallel to the arcuate movement of the blades 14 and 15; a substantially horizontal interface. (FIG. 2 gives a general picture of the blades and contacts as they have been moved from a closed to a contact parted position by rotation at their supports.) The contact fingers 16*a*–16*d* are not totally planar, since (as shown in FIG. 4) they have a bend that makes the principal direct contact with the stabs 17*a* and 17*b* along a line 52 (in the closed switch position). Before the switch reaches a position as shown in FIG. 2, those bends of the fingers move over the surfaces of the stabs with a wiping action that is favorable for good conduction. The contact pressure adjustment mechanism 18 allows a user to set the pressure to a desired level.

(For general reference, switches of the type described typically go to a fully open position only after the blades have turned 90°. In views such as FIG. 2, the contacts have parted and have no more frictional engagement but the blades have not yet reached the fully open position.)

Figure 5:
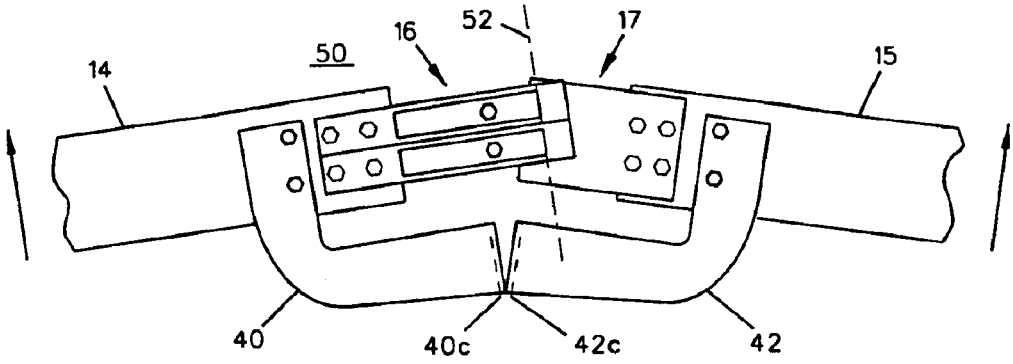
FIG. 5 is a plan view of the apparatus of FIGS. 3 and 4 during movement from a fully closed position.

FIGS. 3 to 5 show a contact assembly 50 that, in addition to the elements that may be otherwise conventional, include a pair of plate-like bars 40 and 42 that are shown respectively attached (e.g., bolted) near a first end 40*a* and 42*a* to the top of a switch blade 14 or 15 and shaped to extend in front of the contacts 16 and 17 to face each other at their ends 40*b* and 42*b* that may have small flanges, as shown.

The bars 40 and 42 need not make physical contact to each other in the fully closed position of the switch, so a gap may occur as shown in FIG. 3. (The "facing" relation is meant to include either with or without a gap). The bars 40 and 42 assist in switch opening. When blade rotation and contact movement has started, the bars 40 and 42 meet at at least part of their facing ends 40*b* and 42*b* (e.g., edge corners 40*c* and 42*c* as shown in FIG. 5) and establish there a new pivot or axis of rotation that facilitates switch opening. The line (or plane) 52 of principal contact engagement and wiping action shifts as the blades move in the directions of the arrows in FIG. 5.

Now, instead of contact sliding friction causing bowing of the supports 12 and 13 so the switch opening is delayed due to extra travel of the contacts 16 and 17 and requires more force, the locus of the pivot comers 40*c* and 42*c* stays substantially fixed through the duration of their contact to each other despite the contact friction.

By way of further example, the bars 40 and 42 are relatively stiff metal plates that are relatively flat although FIG. 4 shows a small angular variation and the abutting ends 40*b* and 42*b* have small vertical flanges. These bars are, looking in the plane of FIG. 3, respectively substantially L-shaped (bar 42) and reverse L-shaped (bar 40) with the bottom leg of each "L" joined at 40*a* and 42*a* to the respective blades and the ends of the top parts of the "L" configurations being the facing ends 40*b* and 42*b*.

One factor making it convenient to attach the bars 40 and 42 to the blades as shown is that the bar ends 40*a* and 42*a* can be bolted to the blades at bolt locations as shown that are the same as those used for attachment of arc horns (which are not shown in these views). This is particularly convenient for putting the assembly together on switches already in the field. A variety of other attachment locations and shapes for members performing the function of bars 40 and 42 will be apparent.

Figure 6:
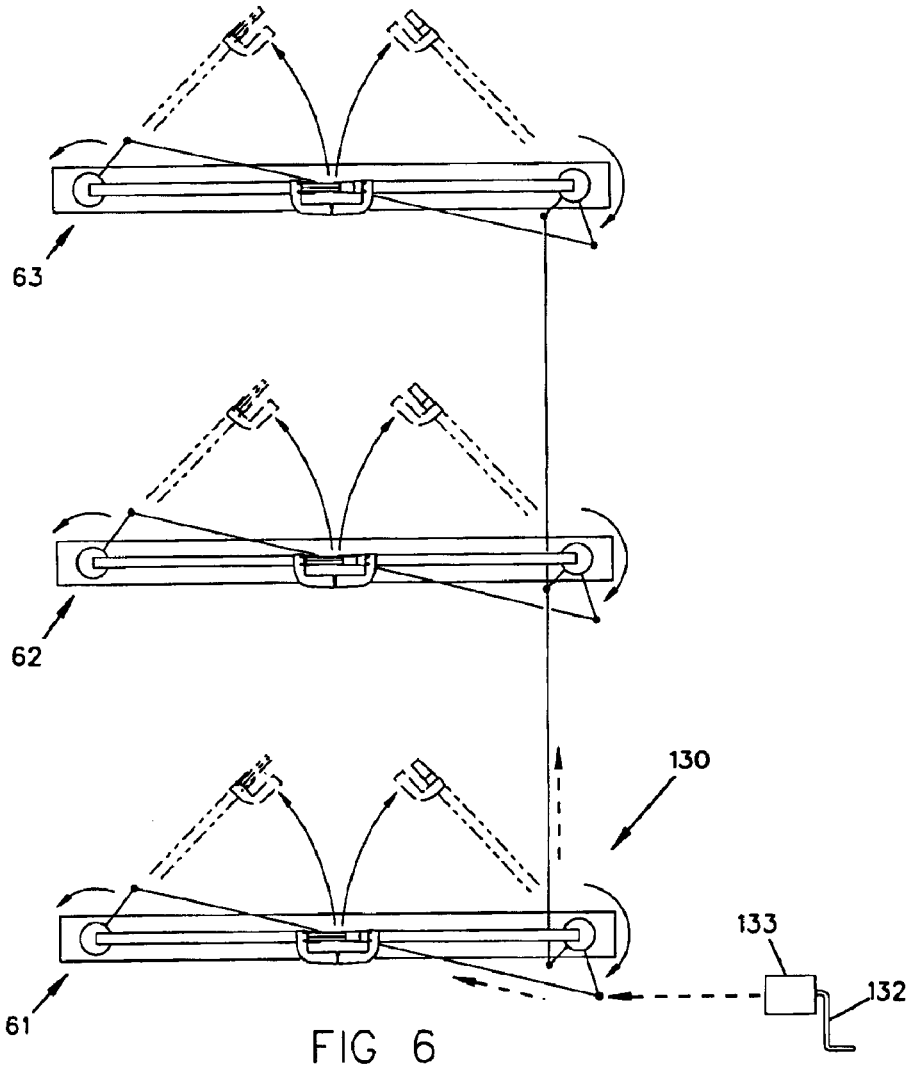
FIG. 6 is a schematic plan view of three mechanically interconnected switches.

FIG. 6 illustrates a three phase switch combination with respective switches 61, 62 and 63 that can each be like that previously described. This schematically shows how a single mechanical arrangement 130 combining tie rods and related parts of each of the three switches are joined together for common operation from a single motive power source, e.g., a handcrank 132 and gearbox 133. This is a common situation and is shown to make the point that the inventive combination has further benefit when practiced in multi-switch gangs where opening force requirements are greater than with a single switch.

The described embodiment is also one that has the facing ends 40*b* and 42*b* that form the pivot point or axis, where corners 40*c* and 42*c* meet per FIG. 5, off of the line 52 of the main contact pressure. This is just one possible location. A general characteristic of the inventive combination is that members comprising the fulcrum mechanism, such as bars 40 and 42, meet and make a pivot point for the blades 14 and 16 at least some part of the time the contacts 16 and 17 are sliding together during a switch opening. Preferably, but not necessarily, the fulcrum mechanism is such that its pivot action occurs substantially throughout the sliding engagement of the contacts. Some benefit can be obtained even if it occurs only part of that time, for example during early contact movement. After the contacts have parted, the fulcrum mechanism need not operate.

Figure 7:
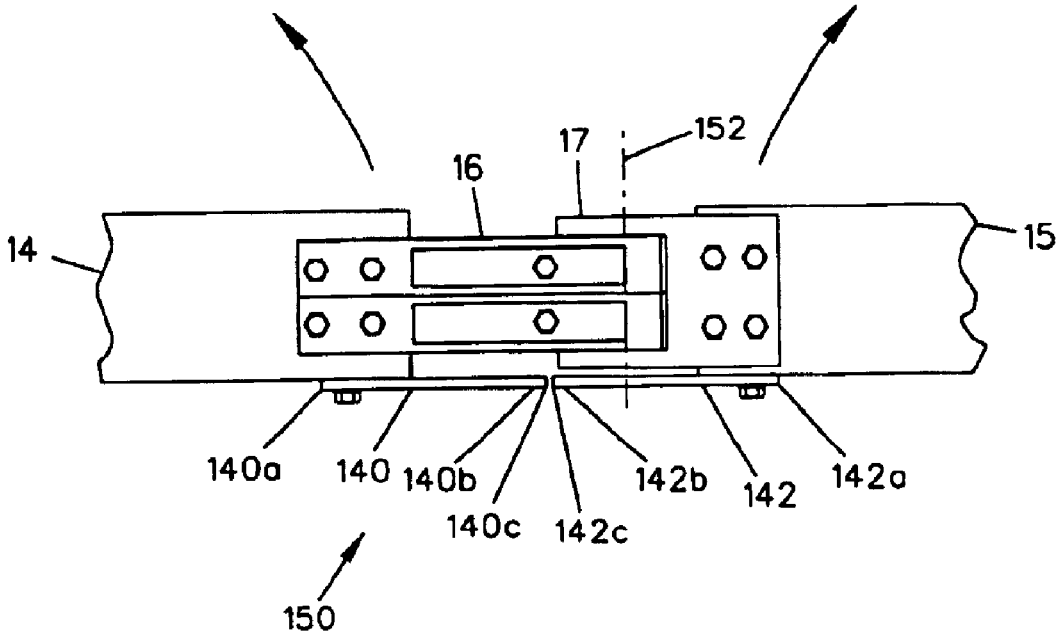
FIGS. 7 and 8 are partial plan views of two alternative embodiments.

FIG. 7 shows an alternative arrangement 150 for pivot members or bars on a switch with other elements as previously described. In this embodiment, the configuration of the blades 14 and 15 and the contacts 16 and 17 is the same as was previously described. The contacts 16 and 17 have a horizontal interface and move in the same direction as the contacts of FIG. 5. However, now pivot members 140 and 142 are attached to respective contact blades 14 and 16 on the side of the blades toward the front of the switch (considering a view such as that of FIG. 1) near their ends 140*a* and 142*a*. The members 140 and 142 are plate-like bars that, in this example, are shown just flat and their ends 140*b* and 142*b* face each other, with a small gap in the closed position. As shown, bars 140 and 142 are equal in length; in general, they can have the same or different shape and size as long as their locations cause the described pivot action. In FIG. 7, as the switch opens, with blade movement as shown by the arrows, the pivot axis will occur at rear (or lower in the drawing) corner edges 140*c* and 142*c*, substantially as it does in the embodiment of FIG. 5. FIG. 7 represents just one alternative form a fulcrum mechanism can take with contacts having horizontal engagement.

Figure 8:
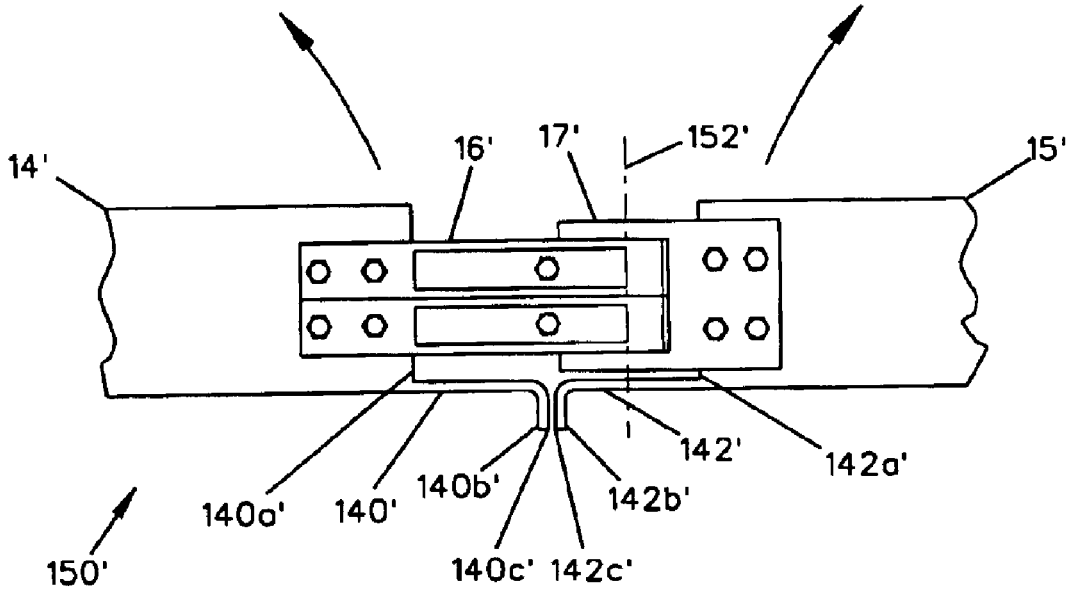

FIG. 8 shows a further alternative arrangement 150'. A fulcrum mechanism comprises elements 140' and 142' that are respectively integral with the blades 14' and 15'. For example, blades in the form of square tubes can have three sides partly cut away leaving portions 140' and 142' extending from the full square configuration. The extended material can be formed as desired, such as to form the illustrated flange portions at 140*b*' and 142*b*' that face each other and whose back corners 140*c*' and 142*c*' initially engage to provide a pivot as the contacts open.

A variety of contact arrangements for center break switches are used in the art other than that shown for contacts 16 and 17. Some have principal contact engagement and a degree of wiping action that is not in a plane parallel to the arcuate blade movement. For example, the contact faces may principally engage in a substantially vertical interface plane. Even so, to the extent the contacts engage with sliding friction in any of these alternative contact configurations, the present invention can be beneficial to facilitate switch opening.

Figure 9:
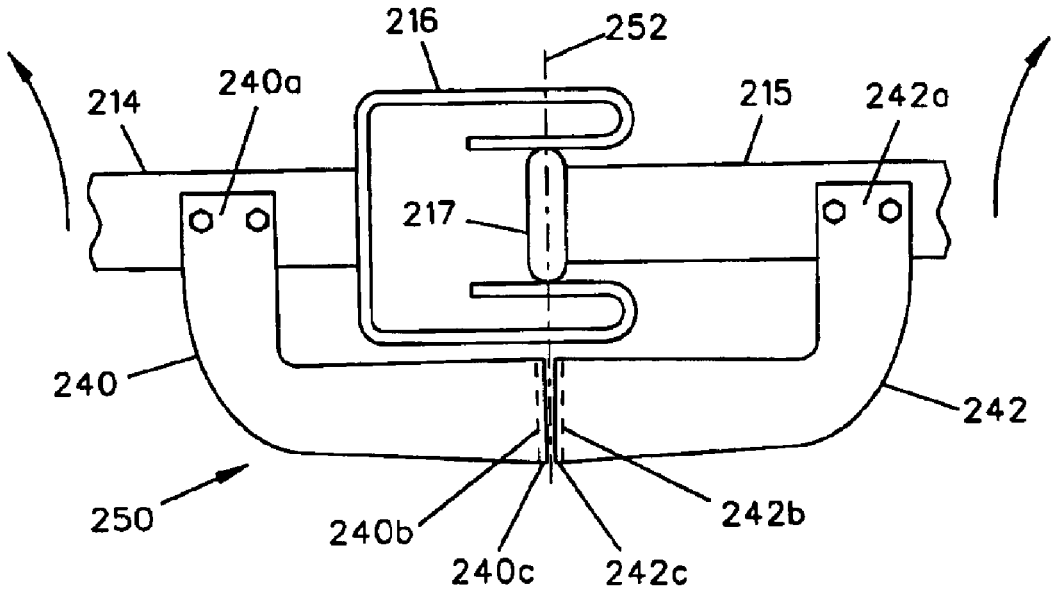
FIGS. 9 and 10 are, respectively, partial plan and elevation views of a further embodiment.
Figure 10:
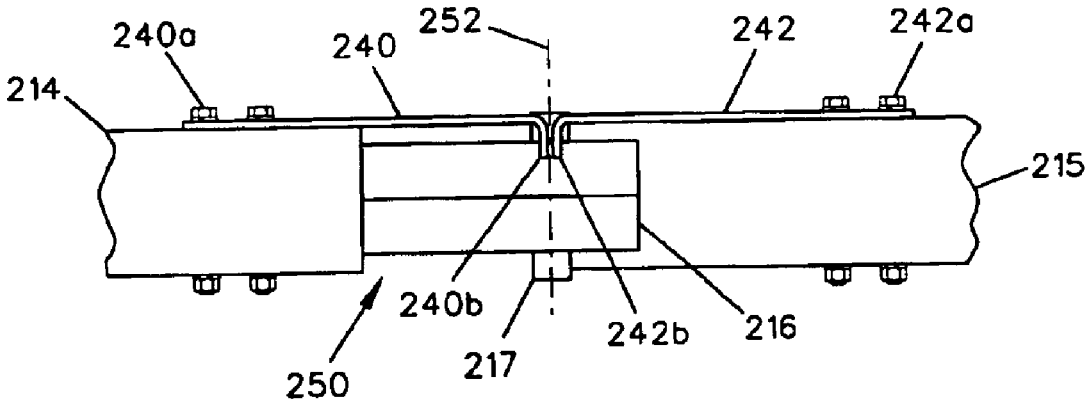

FIGS. 9 and 10 show an example of a combination 250 of pry bars with a pair of contacts with a vertical interface. Blade 214 supports a first contact 216 that has a loop forming a jaw within which a stab-like second contact 217 on blade 215 is engaged. A closed switch is shown. The arrows in FIG. 9 show the directions the blades 214 and 215 will take during a switch opening. During that movement, front and back fingers of contact 116 slide against front and back ends of contact 217 and produce sliding friction.

The combination 250 includes pry bars 240 and 242 that are arranged and operate in substantially the same way as bars 40 and 42 previously described. Here the bars 240 and 242 are merely flat from their secured ends 240*a* and 242*a* out to their facing ends 240*b* and 242*b* at which a small vertical flange occurs. Also, it will be noted the bars 240 and 242 will meet and pivot, at the back comers 240*c* and 242*c*, along the same line as that on which the contacts engage in the closed position.

It is, therefore, apparent that the invention applies either in the case in which the contacts engage with sliding friction in a plane orientated the same as the plane of the movement of the blades or the case in which the plane of contact engagement is perpendicular to the blades' plane of motion. Also, it can be understood that the contacts can be configured with elements such that they engage, and slide, in both planes.

Among the considerations for members in the fulcrum, or open-assist, mechanism is to make any gap between them in the closed position as small as reasonably attainable so the pivot action can commence promptly upon contact movement. The gap can be avoided entirely although it is not generally preferred to have any conduction across the bars, if of metal, when closed. However, the bars need not be metal but may instead be of an insulative material such as fiber reinforced plastic, at least at the facing ends, so direct contact when closed would not be a concern.

The illustrated embodiments have a geometry for the open-assist elements with a pivot axis centered in relation to the blades and the blade supports although the contacts have a line of primary engagement, as shown in FIGS. 3, 7, and 8, not quite centered between the ends of blades 14 and 15 or 14' and 15'. Symmetrical elements 40 and 42, 140 and 142, and 140' and 142' are generally preferred for typical switches, such as those with equal length blades. Variations can be implemented in which the abutting elements are not symmetrical; in general, they can have the same or different shape and size, and the same or different relative locations on the blades, as long as they meet to perform the described pivot action during the sliding engagement of the contacts.

While the description sometimes refers to "upper", "lower", "top" or "bottom", "horizontal" or "vertical" orientations (consistent with the Figures), it will be understood the described switches can be mounted in essentially any orientation.

The specific embodiments disclosed are merely some examples of the various ways in which the invention can be practiced.

What is claimed is:

1. A center break switch comprising:

a base;

a pair of switch blades, each having a switch contact and each mounted on the base by a rotatable support structure combined with an operating mechanism that moves the switch blades and their contacts between closed and open positions upon application of a motive force to the operating mechanism, each switch blade also having a line terminal;

the support structure and operating mechanism being related for rotation of each blade's support structure proximate the base with resulting movement of the blades and contacts arcuately between the closed and open positions; and a pair of pry bars, each of the pair being attached to one of the blades proximate the contact with the bars arranged to have facing ends that work pivotally against each other during at least part of a switch opening operation of the operating mechanism to facilitate opening of the contacts.

2. The switch of claim 1 where:

the pry bars, at their facing ends, are located, relative to the contacts on the blades, opposite the direction of movement of the contacts during switch opening.

3. The switch of claim 1 in a combination further comprising:

two additional center break switches each with a pair of switch blades and related contacts, a pair of pry bars, each of the pair of pry bars being attached to one of the blades proximate the contact with the bars arranged to have facing ends that work pivotally against each other during at least part of a switch opening operation of the operating mechanism to facilitate opening of the contacts, a pair of line terminals and a pair of support structures, with each of the three pairs of blades of the three switches being connectable at their line terminals to a respective phase of a three-phase electrical system; and the operating mechanism includes elements joined together for common operation of all three switches by a single source of motive power.

4. The combination of claim 3 where:

the operating mechanism includes a manual operator or a motor operator.

5. The switch of claim 1 where:

the switch contacts engage each other with sliding friction during a period of movement of the switch blades from the closed to open positions.

6. The switch of claim 5 further comprising:

a contact tightening mechanism that allows adjusting the pressure on the contacts in the closed position to a desired amount.

7. The switch of claim 5 where:

the contacts, at least in part, have a configuration with mutual engagement in a plane substantially the same as that in which the arcuate movement of the blades occurs.

8. The switch of claim 5 where:

the support structure of each blade is insulative and extends a length from the base with an axis of rotation running along the lengths.

9. The switch of claim 8 where:

the pry bars each comprise a rigid member secured to the respective blades so extremities of the bars face each other in the fully closed position of the switch contacts and mechanically engage as a pivot axis for a time during which the contacts engage with sliding friction.

10. The switch of claim 9 where:

the bars are secured to the blades at locations for attachment of additional elements for arc suppression.

11. The switch of claim 9 where:

the bars are of metal and are shaped and are attached to the blades with space avoiding any direct contact to the switch contacts and with a small gap, in the fully closed position, avoiding direct contact to each other.

12. The switch of claim 11 where:

the bars each have a flange-like portion at the extremities.

13. The switch of claim 9 where:

the bars, at least the extremities thereof, are insulative and are arranged with either a small gap or no gap between them in the closed position.

14. The switch of claim 9 where:

the bars are plate-like members substantially parallel to the plane of arcuate movement of the switch blade; and the extremities of the plate-like members each have a corner edge, on the side thereof away from the contacts, that engage to provide the pivot axis.

15. A switch comprising:

a pair of switch contacts;

a pair of supports that each support one of the switch contacts;

a switch operating mechanism related with the contacts and their supports for relative motion of the contacts in an arcuate path including motion, in a switch opening, from a fully closed position in which the contacts are stationary and conductively engaged, through a partly open position in which the contacts have relative motion while conductively engaged with sliding friction, to an open position in which the contacts are separated; and a fulcrum mechanism comprising elements, in addition to the switch contacts, located proximate to and behind the contacts in relation to the path of relative motion, that meet to provide a prying action increasing leverage to help overcome the sliding friction between the contacts in movement through the partly open position.

16. The switch of claim 15 where:

the elements of the fulcrum mechanism form a pivot axis that is substantially fixed in location while the contacts are engaged with sliding friction in the partly open position.

17. The switch of claim 15 where:

the elements of the fulcrum mechanism comprise a pair of bars respectively attached to a pair of contact blades and the bars engage each other and together form a pivot axis to provide the prying action as the switch contacts slide against each other in the partly open position.

18. The switch of claim 15 where:

the contacts have frictional engagement during switch opening in a first plane in which the blades move during rotation of the supports or a second plane perpendicular to the first plane, or in both planes.

19. The switch of claim 17 where:

the fulcrum mechanism comprises a pair of members respectively attached to each of the pair of contact blades.

20. The switch of claim 17 where:

the fulcrum mechanism comprises a pair of elements respectively integral with each of the pair of contact blades.

* * * * *

UNITED STATES PATENT AND TRADEMARK OFFICE

CERTIFICATE OF CORRECTION

PATENT NO. : 6,984,795 B1
DATED : January 10, 2006
INVENTOR(S) : Kowalik

It is certified that error appears in the above-identified patent and that said Letters Patent is hereby corrected as shown below:

Title page,
Item [56], References Cited, U.S. PATENT DOCUMENTS, add:
-- 3,244,825 A * 4/1966 Killian et al.
3,627,939 A * 12/1971 Myers
4,795,869 A * 1/1989 Roman et al. --.

Column 4,
Line 44, change "6*b*" to -- 16*b* --.

Column 5,
Line 63, change "comers" to -- corners --.

Column 7,
Line 26, change "116" to -- 216 --.
Line 34, change "comers" to -- corners --.

Column 9,
Line 4, change "lengths" to -- length --.

Signed and Sealed this

Second Day of May, 2006

JON W. DUDAS
*Director of the United States Patent and Trademark Office*